US005510807A

United States Patent [19]

Lee et al.

[11] Patent Number: 5,510,807

[45] Date of Patent: Apr. 23, 1996

[54] DATA DRIVER CIRCUIT AND ASSOCIATED METHOD FOR USE WITH SCANNED LCD VIDEO DISPLAY

[75] Inventors: Sywe N. Lee, Taiwan; Dora Plus, Shinchu, both of Taiwan

[73] Assignee: Yuen Foong Yu H.K. Co., Ltd., Kowloon, Hong Kong

[21] Appl. No.: 1,127

[22] Filed: Jan. 5, 1993

[51] Int. Cl.[6] ..... G09G 3/36

[52] U.S. Cl. ..... 345/103; 345/208; 345/94

[58] Field of Search ..... 345/94, 57, 203, 345/92, 100, 101, 208, 94, 103

[56] References Cited

U.S. PATENT DOCUMENTS

| | | | |
|---|---|---|---|
| 4,231,035 | 10/1980 | van Doorn et al. . | |
| 4,233,603 | 11/1980 | Castleberry . | |
| 4,403,217 | 9/1983 | Becker et al. . | |
| 4,922,240 | 5/1990 | Duwaer . | |
| 4,931,787 | 6/1990 | Shannon . | |
| 5,113,181 | 5/1992 | Inoue et al. . | |
| 5,148,058 | 9/1992 | Stewart . | |
| 5,151,689 | 9/1992 | Kabuto et al. . | |
| 5,151,805 | 9/1992 | Takeda et al. . | |
| 5,159,325 | 10/1992 | Kuijk et al. . | |
| 5,206,632 | 4/1993 | Dupont et al. . | |
| 5,245,579 | 9/1993 | Ohta | 365/203 |
| 5,250,937 | 10/1993 | Kikuo et al. | 345/101 |
| 5,377,030 | 12/1994 | Suzuki et al. | 359/57 |
| 5,426,447 | 7/1995 | Lee | 345/94 |
| 5,436,635 | 7/1995 | Takahara et al. | 345/92 |

FOREIGN PATENT DOCUMENTS

| | | |
|---|---|---|
| 0186540A1 | 7/1986 | European Pat. Off. . |
| 0417578A2 | 3/1991 | European Pat. Off. . |
| 2162984A | 2/1986 | United Kingdom . |
| WO9209986 | 6/1992 | WIPO . |

*Primary Examiner*—Richard Hjerpe
*Assistant Examiner*—Martin Loui
*Attorney, Agent, or Firm*—Jones, Day, Reavis & Pogue

[57] ABSTRACT

A data driver circuit and system driving scheme that can be integrated directly onto an LCD display substrate to reduce the cost of the peripheral integrated circuits and the hybrid assembly needed by unscanned active matrix liquid crystal displays to connect them to the array. A demultiplexer circuit is deposited on the display for demultiplexing a group of Y columns of multiplexed video data input signals to X groups of Y pixel capacitors that are also deposited on the substrate in Z rows. In addition, a data driver circuit provides voltage signals to precharge the pixel capacitors to a first voltage level in a first time period such that video data input signals coupled thereto in a multiplexed fashion during a second time period causes the pixel capacitors to store to a second predetermined voltage level to provide a video display as the rows of pixels are sequentially scanned.

12 Claims, 5 Drawing Sheets

DATA DRIVER CIRCUIT AND ASSOCIATED METHOD FOR USE WITH SCANNED LCD VIDEO DISPLAY

BACKGROUND OF THE INVENTION (1) Field of the Invention

The present invention relates generally to video displays and their associated driving circuits and in particular to LCD video display column driving circuits that use a simplified multiplexing arrangement for data lines and pixel capacitors that are precharged to a selected voltage level prior to the application of video data signals to enable selected ones of the data lines and pixel capacitors to be additionally charged or discharged to an appropriate level by the incoming video data signals to enhance the operation of the display.

(2) Description of Related Art

Matrix display devices commonly utilize a plurality of display elements that are arranged in a matrix of rows and columns and supported on opposing sides of a thin layer of electro-optic material. Switching devices are associated with the display elements to control the application of data signals thereto. The display elements include a pixel capacitor driven by a transistor as a switching device. One of the pixel electrodes is on one side of the matrix display and a common electrode for each of the pixels is formed on the opposite of the matrix display. The transistor is usually a thin-film transistor (TFT) that is deposited on a transparent substrate such as glass. The switching transistor has its source electrode connected to the pixel electrode that is deposited on the glass on the same side of the display matrix as the switching transistor. The drain electrodes of all of the switching transistors in a given column are connected to the same column conductor to which data signals are applied. The gate electrodes of all of the switching transistors in a given row are connected to a common row conductor to which row selection signals are applied to switch all the transistors in a selected row to the ON condition or state. By scanning the row conductors with the row selection signals, all of the switching transistors in a given row are turned ON and all of the rows are selected in a sequential fashion. At the same time, video data signals are applied to the column conductors in synchronism with the selection of each row. When the switching transistors in a given row are selected by the row select signal, the video data signals supplied to the switching transistor electrodes cause the pixel capacitors to be charged to a value corresponding to the data signal on the column conductor. Thus each pixel with its electrodes on opposite sides of the display acts as a capacitor. When the signal for a selected row is removed, the charge in the pixel capacitor is stored until the next repetition when that row is again selected with a row select signal and new voltages are stored therein. Thus a picture is formed on the matrix display by the charges stored in the pixel capacitors.

It is also known to precharge the pixel capacitors of the presently selected row to a predetermined voltage level prior to the video data signals being applied to the column conductors as set forth in commonly assigned copending application Ser. No. 971,721, filed Nov. 3, 1992. By doing so, the pixel capacitor can then be additionally charged or discharged to the level of the succeeding video data in a shorter time period than required if the pixel capacitor was charged only by the video data signals. To accomplish the precharging function, precharging TFTs are deposited onto the glass substrate with each of the drain electrodes connected to a column conductor and each of the gate electrodes connected together and to a precharge circuit and each of the source electrodes connected to a predetermined voltage source.

Then prior to the video data signals being applied, the precharge circuit turns ON each of the precharging TFTs thereby allowing the voltage source to charge the pixel capacitors to a predetermined level.

It is to be understood that the use of the term "video" herein, although it has been generally applied to the use of signals for television, is intended to cover displays other than TV pictures or displays. Such displays may be hand-held games having an LCD display with moving figures thereon and the like.

SUMMARY OF THE INVENTION

The present invention is directed to a new data driver circuit for use with a scanned LCD video display. In the present invention using a 384×240 pixel color hand-held TV as an example, the demultiplexer elements are fabricated as thin-film transistors (TFTs) on the display itself to transfer a precharging voltage and video data from an off-glass source to the on-glass pixel capacitors of the display. The demultiplexer elements are divided into a predetermined number of groups and a demultiplexing circuit controls the activation of these groups. The demultiplexing circuit consecutively and sequentially enables each of the groups of demultiplexer elements in order to provide video data to charge the pixel capacitors to a corresponding level. Prior to the video data being provided, a control circuit provides a precharging voltage and the demultiplexing circuit enables each of the groups of demultiplexer elements simultaneously to allow all of the pixel capacitors of the selected row to be charged to a predetermined level.

Therefore, it is an object of the present invention to provide a simplified means for precharging the pixel capacitors.

It is a further object to reduce the manufacturing costs of the LCD display by reducing the number thin-film components required to be deposited on the display.

It is a still further object of the present invention to provide a more reliable column data driver circuit by reducing the number of on-glass components required.

BRIEF DESCRIPTION OF THE DRAWINGS

These and other features of the present invention will be more fully disclosed in the following detailed description of the drawings in which like numerals represent like elements and in which.

DESCRIPTION OF THE PREFERRED EMBODIMENT

Figure 3:
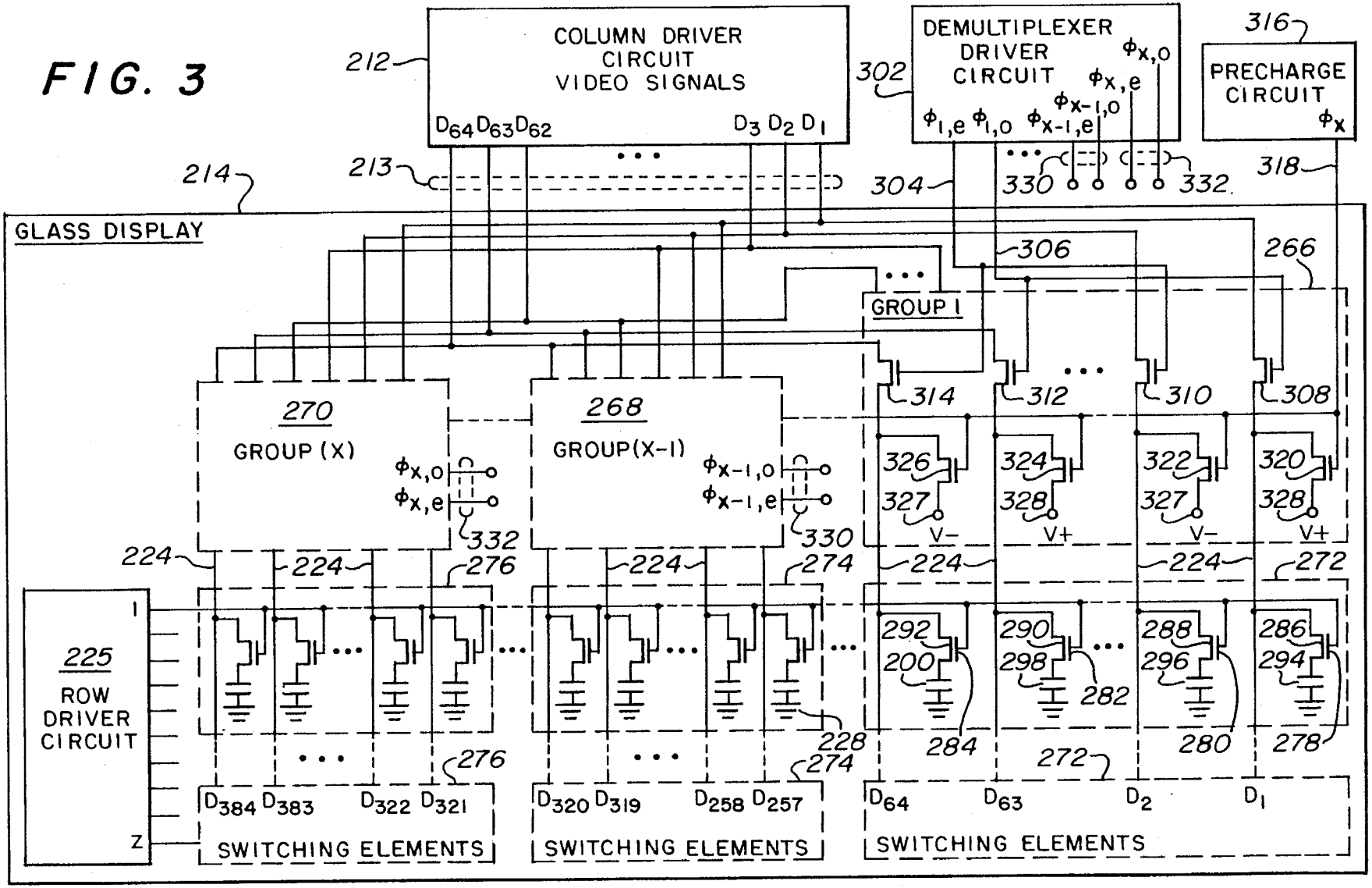
FIG. 3 is a detailed diagram of a matrix array and data scanning circuits disclosed in a commonly assigned copending patent application.

The circuit of FIG. 3 is disclosed in detail in commonly assigned copending application Ser. No. 971,721 filed Nov. 3, 1992 entitled "DATA DRIVING CIRCUIT FOR LCD DISPLAY" which is incorporated herein in its entirety by reference.

Figure 1:
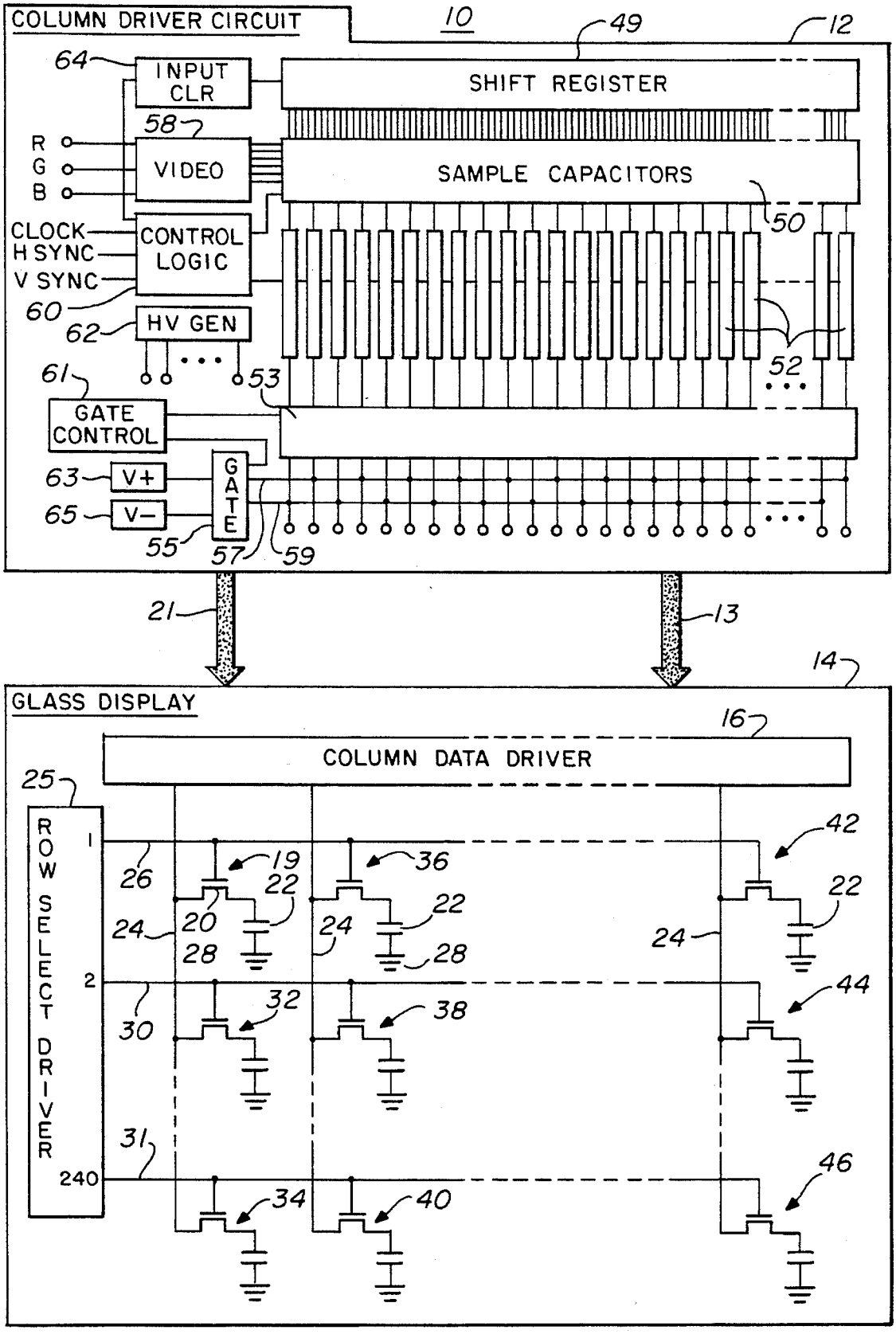
FIG. 1 is a basic block diagram of the novel system and data driver circuit for a self-scanned TFTLCD video display.

FIG. 1 is a basic block diagram of the novel display system 10 which includes the display device 14 and the "off-glass" control circuits 12 that are separate from and connected to the display 14 to drive the elements thereon. An active matrix liquid crystal display (AMLCD) of the type illustrated in FIG. 1 may typically consist of 200,000 or more display elements. Clearly, for displaying television pictures, the greater the number of display elements, the greater the resolution of the picture. For a hand-held TV, for example, the array may include 384 columns and 240 rows. In such a case, in excess of 92,000 display elements or pixels are required. For larger sets, of course, the number increases. The transistors used to drive the pixels are usually thin-film transistors (TFTs) deposited on a substrate such as glass. The display elements include electrodes deposited on the glass and common electrode elements on an opposing substrate, the opposing substrates being separated by an electro-optic material. On the substrate 14, which may be glass, the column data driver circuits 16 drive the column lines 24 with the video data signals and precharging voltage. The row select driver 25 may be of any type well known in the art, preferably of the type disclosed in commonly assigned copending application Ser. No. 07/996,979, filed Dec. 24, 1992 and entitled "A SELECT DRIVER CIRCUIT FOR AN LCD DISPLAY", and sequentially activates the pixels in each selected row and the rows 1 through 240 are driven sequentially.

In the external control circuits 12 that are separate from the display 14, sample capacitors 50 receive data from input circuit 64 through shift register 49. The red, green and blue video signals are coupled from circuit 58 to the sample capacitors 50 in concert with the data in the shift registers 49. The clock signals and horizontal and vertical synchronization signals are provided by control logic 60. A high voltage generator 62 provides the necessary high voltage power. The output of the sample capacitors 50 are coupled to 64 output amplifiers 52. In turn, the amplifiers 52 are coupled to a gate 53 for controlling the output of the video data. A gate 55 is coupled to voltage sources 63 and 65 and controls the voltages on lines 57 and 59 to allow a precharging voltage to be provided to substrate 14. A gate control 61 controls gates 53 and 55 such that only one gate is enabled at a time. Line 57 is coupled to each odd output line $D_1$, $D_3$ - - - $D_{63}$ and line 59 is coupled to each even input line $D_2$, $D_4$ - - - $D_{64}$.

Thus, if one row of pixels includes 384 display elements, the 64 data input lines 13 are coupled in multiplexed fashion, 64 bits at a time, to the 384 display elements on the substrate 14 after a precharge voltage is applied. The 64 video outputs are coupled on line 13 to the column conductors 24 through column data drivers 16 as will be disclosed hereafter.

Figure 2:
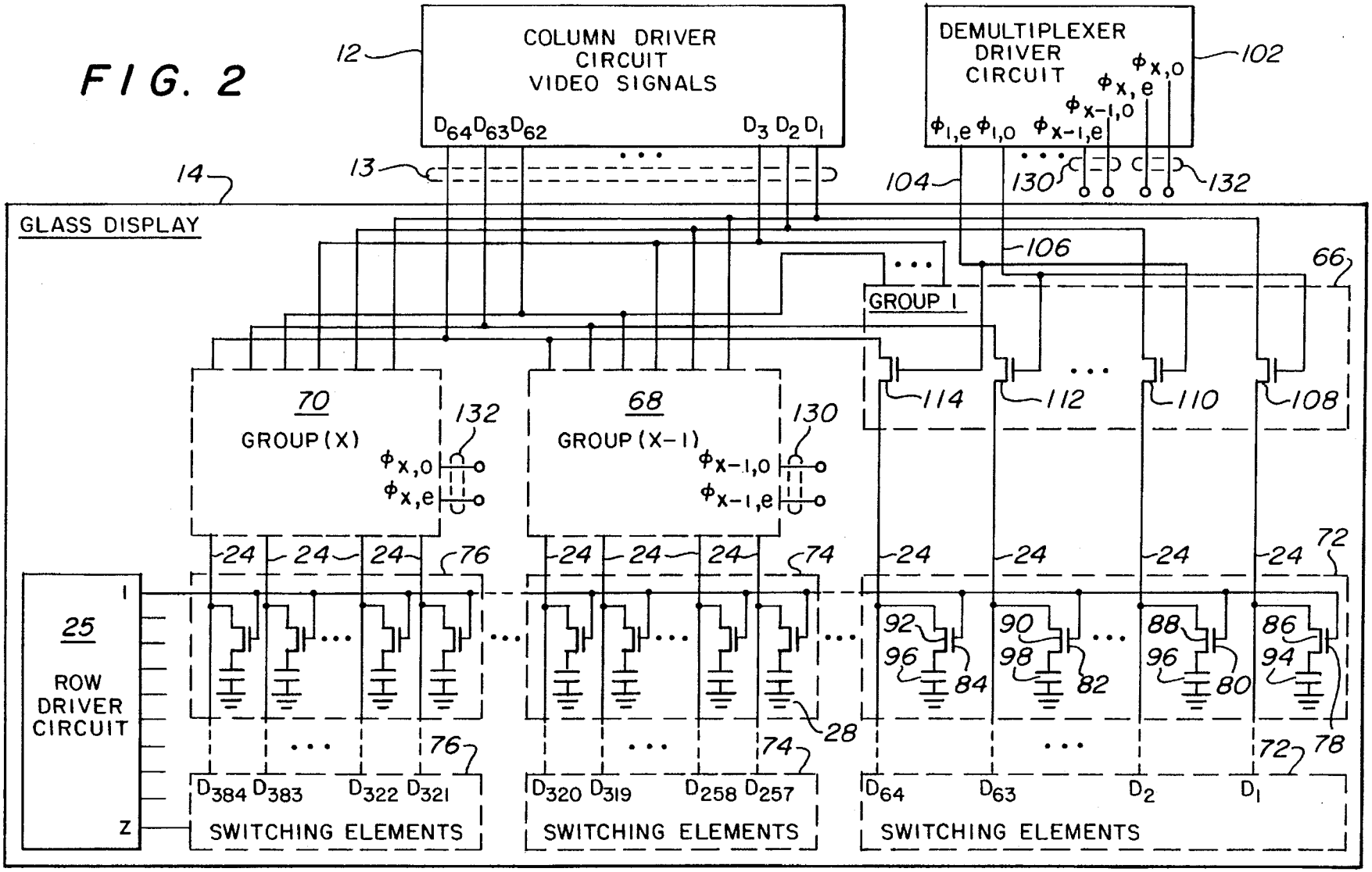
FIG. 2 is a detailed diagram of the matrix array on glass and the data scanning circuits associated therewith in accordance with the present invention.

As seen in FIG. 2, lines 104, 106, - - - 130, and 132 from a demultiplexing circuit 102 form six pairs of enabling signal lines that are applied to X(6) groups, designated as 66, - - - 68 and 70, of Y(64) demultiplexing elements. These elements are designated as 108, 110 - - - 112, and 114 and are deposited on glass 14 to demultiplex the 64 output signals and couple them sequentially to the X (6) different groups (66 - - - 68, 70) of Y(64) column lines 24 in a selected one of Z (240) rows on the glass 14. Also, the lines 104, 106, - - - 130, and 132 enable all 384 demultiplexing elements (108, 110 - - - 112, and 114 in each group) simultaneously for a time period prior to the video data being applied to substrate 14 to allow the display elements to be precharged to a predetermined voltage level. The row select driver signals, the clock and power lines are coupled from the control circuit 12 on line 21 to the row select driver circuit 25 as shown in FIG. 1. Row select driver circuit 25 may be any of such type of circuits well known in the art but is preferably of the type disclosed in commonly assigned copending application Ser. No. 07/996,979, filed Dec. 24, 1992.

Figure 5:
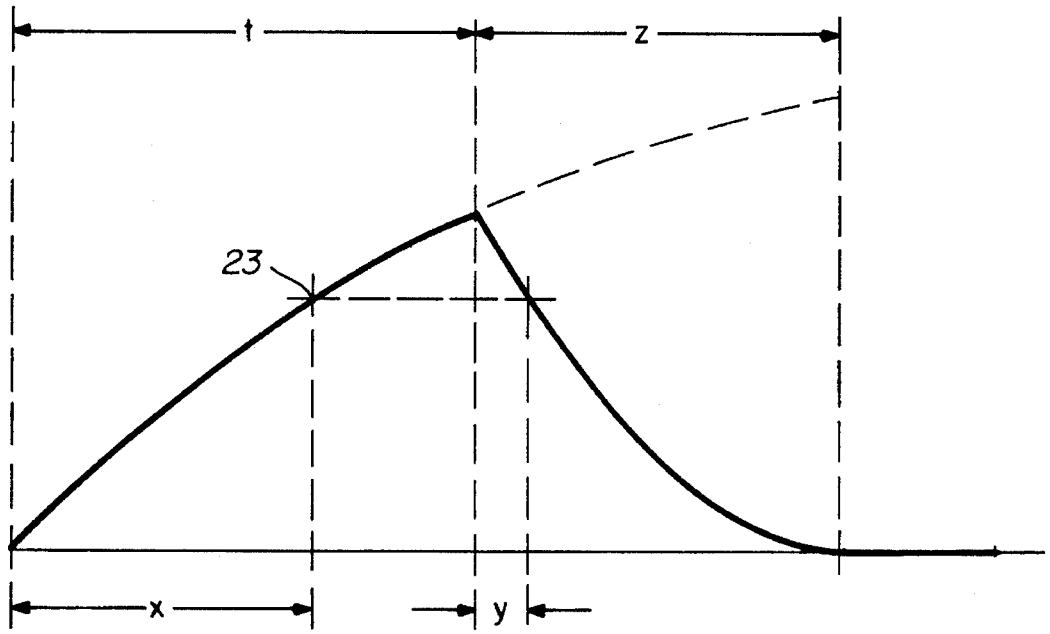
FIG. 5 is a diagram of a capacitor charge waveform illustrating that a capacitor discharges faster than it charges.

As shown in FIG. 3, if the first row is selected by row select driver circuit 225, the transistors 278, 280, 282, and 284 in row 1 will all be activated. Then, a precharging circuit 316 and the X column data driver circuits 266, - - - 268, and 270 will provide signals that will precharge each column line and each of the pixel capacitors 294, 296, - - - 298, and 300 in the first row of row driver 225 to a preselected voltage. Then, as the data signals are applied to the column lines 224, the capacitors will be further charged or discharged by an amount that depends upon the level of the data signal being applied to the column lines 224. Precharge of the capacitors is used because the capacitors 294, 296, - - - 298, and 300 are able to discharge much faster than they charge as illustrated in FIG. 5. As can be seen in FIG. 5, for the capacitor to charge from 0 to a value designated by the numeral 23, takes X amount of time. However, for the capacitor to discharge from its maximum value to that same level takes only Y amount of time which is much smaller than X. Further, it takes time, t, to charge to its full amount and a lesser time, Z, to discharge completely. Thus, the discharge times are much more rapid than the charge times thereby enabling the discharge of the data line capacitors to their proper voltage level during the data signal input time interval. This can shorten the time required for the data input time interval.

Thus, in the circuit of FIG. 3, a precharge circuit 316 generates an output signal on line 318 that is coupled to the gates of all 384 precharge transistors 320, 322, 324, and 326, one of which is coupled to each of the 384 column lines on the substrate 214. A sample of the precharge transistors is shown in group 1, designated by the block numbered 266. Precharge transistor 320 has its drain connected to a voltage source, V+, and its source electrode coupled to internal data line column $D_1$. All of the odd column lines have such a transistor coupled thereto. For instance, in FIG. 3, transistors 320 and 324 have their drain electrodes coupled to a V+ voltage source 328. The transistors 322 and 326 for the even column lines have their drain electrodes connected to a V− voltage source 327.

The present invention eliminates the need for the precharging circuit 316 and transistors 320, 322 - - - 324, and 326 of FIG. 3 while still maintaining the precharging function and advantages outlined above, as seen by comparing FIG. 3 with FIG. 2. As shown in FIG. 1, this is accomplished by alternately turning OFF gate 53 and turning ON gate 55 with gate control 61 to allow voltage sources 63 and 65 to charge lines 57 and 59 to a predetermined level for a specified time period. Then, for the same time gate 55 is turned ON, demultiplexing circuit 102 in FIG. 2 simultaneously enables the X groups of Y demultiplexing elements (108, 110 - - - 112, and 114) shown in FIG. 2. This allows capacitors 94, 96, 98, and 100 to be charged to the predetermined voltage.

Thus, with each row sequentially energized, all of the pixel capacitors in all groups in a selected row are charged simultaneously to their predetermined value and are discharged sequentially in X groups as the video signals are received. Thus, X groups of Y switching transistors (78, 80, 82, and 84) in Z rows are deposited on the substrate 14. If the display should be, for example only, a 384×240 pixel display, there could be six groups of 64 switching elements in 240 rows deposited on the substrate. Such example will be discussed herein.

FIG. 2 is a more detailed diagram of the substrate 14. Again, a control circuit 12, external to the substrate, provides precharging voltages and video signals on lines 13 to the substrate 14. Also, the row driver circuit 25, which may be of the type previously described, includes TFT transistors operated from control signals on line 21 in FIG. 1, sequentially selects a row, as is well known in the art. Rows are indicated in FIG. 2 as 1–Z rows and only the first and last rows are shown. The remaining rows are identical. It will also be noted in FIG. 2 that there are X groups of Y switching elements. A switching element comprises a transistor and its associated pixel capacitor. In the first group designated by the numeral 72, there are shown only four switching elements 86, 88, 90, and 92 for purposes of simplicity. In actuality there would be 64 such switching elements if the X groups were six groups and the total number of columns used was 384 columns. The gates of the transistors 78, 80, 82, and 84, which may be thin-film transistors deposited on the glass substrate 14, are coupled through row conductor 1 to the row driver circuit 25. A pixel capacitor or display element (94, 96, 98, and 100) is connected to the respective source electrodes of the transistors 78, 80, 82, and 84. The electrode 28 is the second plate of the pixel capacitor and is the ground or common electrode segment that is located on the opposing substrate of the display 14.

In contrast to the circuit of FIG. 3, the present invention, as seen in FIGS. 1 and 2 generates a precharging voltage in lines $D_1$ through $D_{64}$ when gate control 61 turns OFF gate 53 and opens gate 55. Gate control 61 alternately enables and disables gates 53 and 55 such that only one gate is enabled at a time. This allows voltage sources 63 and 65 to charge the odd and even lines $D_1$ through $D_{64}$, respectively. While gate 55 is open, demultiplexing circuit 102 generates clock signals to turn ON transistors 108, 110 - - - 112, and 114 in all groups, thus allowing all capacitors 94, 96, 98, and 100 to be charged in the selected row.

As seen from the above discussion, the present invention allows the elimination of 384 TFTs (320, 322, 324, and 326) on the display substrate shown in FIG. 3. This, in turn, reduces manufacturing costs and increases production yield and reliability. The function of precharge circuit 316 is performed by control circuit 12 and demultiplexing circuit 102 in the present invention. After the precharging function is performed, the operation of the circuit of FIG. 3 and the circuit of the present invention are exactly the same.

Figure 4:
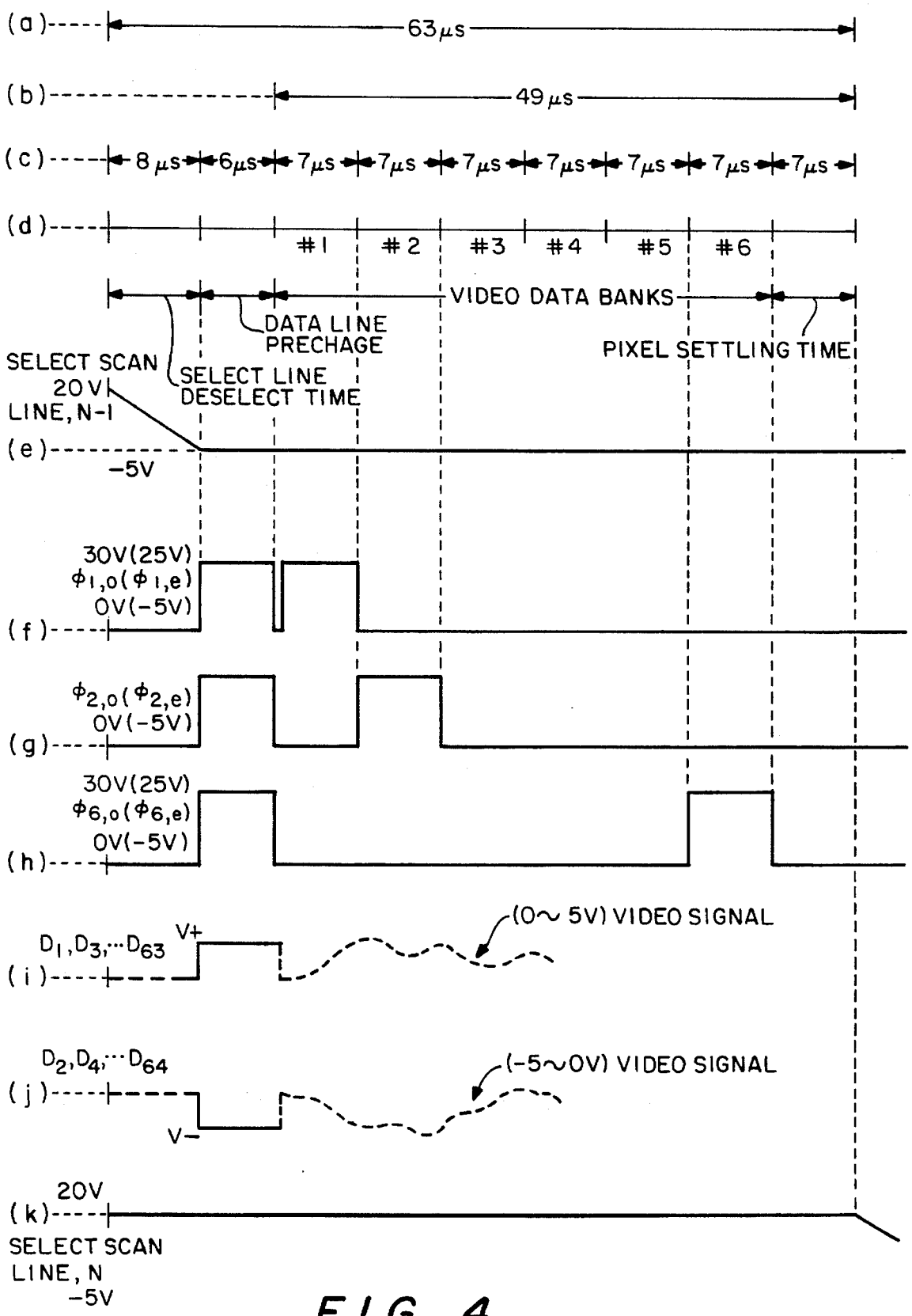
FIG. 4 illustrates the waveforms and timing of the present invention.

Referring now to FIG. 2 in conjunction with the timing diagram in FIG. 4, it can be seen in line (a) that the scanning line time interval is approximately 63 microseconds for a 384×240 pixel display interfacing with the NTSC TV system. The budgeted line time is 8 microseconds for previous line deselection, 6 microseconds for scan data line precharge, 42 microseconds for the video data transferring in demultiplexed fashion from an external video source to the X groups of data lines of the display and 7 microseconds for the pixels to settle. This can be seen in line (c). Thus, reviewing line (d) of FIG. 4, it can be seen that during the first 8 microseconds of the deselect time, the previously scanned line, n–1, is discharged from a select level such as 20 volts to a negative 5 volts deselected level as shown in line (e) of FIG. 4. This isolates all pixel capacitors in line n–1 so that they hold their video data charge. Following the deselect time of 8 microseconds, the precharge signals for row n shown in lines (i) and (j) adjust to a preselected voltage such as ±5 volts for 6 microseconds. As shown by the first pulse in lines (g), (h), (i) and (j), during this 6 μs precharge time all demultiplexer signals are pulsed high. This turns ON transistors 108, 110 - - - 112, and 114 in all groups such that odd numbered data lines, $D_1$, $D_3$ - - - $D_{383}$, are charged to the $V^+$ level and even numbered data lines, $D_2$, $D_4$ - - - $D_{384}$, are charged to the $V^-$ level. In contrast, in the circuit of FIG. 3, $\Phi_x$ from precharge circuit 316 would be pulsed high to turn ON the transistors 320, 322 - - - 324, and 326 such that the odd numbered internal data lines $D_1$, $D_3$, - - - $D_{383}$ are precharged to the V+ level and the even-numbered internal data lines $D_2$, $D_4$, - - - $D_{384}$ are precharged to $V^-$ level in 6 μs. So it can be seen that the first precharge pulses of lines (f), (g), (h), (i) and (j) of FIG. 4 replace the function of $\Phi_x$ of the circuit in FIG. 3. It is also noted, as those skilled in the art will appreciate, that in line (f) of FIG. 4 a single pulse of approximately 13 μs could be used to replace the two consecutive precharge and video control pulses shown. This is because the second pulse follows the first so closely that a single pulse would have the same effect.

Figure 6:
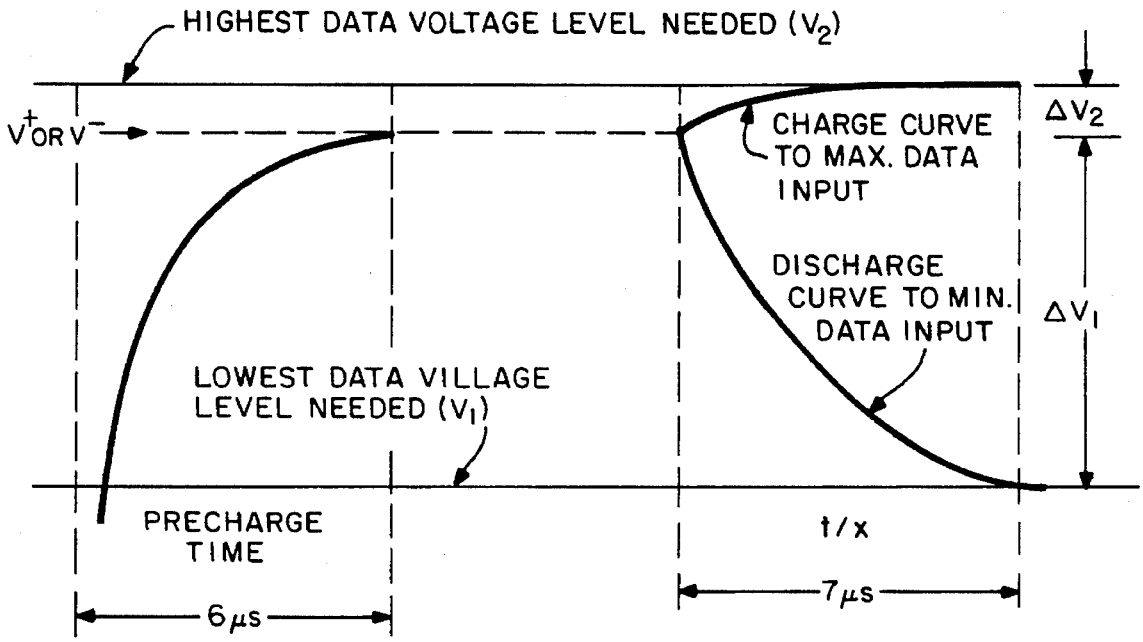
FIG. 6 is a waveform illustrating the time saving benefits of applying less than a full precharge voltage V+ or V− to the pixel capacitors.

The $V^+$ voltage level is approximately 5 volts and the $V^-$ voltage level is approximately 0 volts, for example. It should be understood, however, that these voltage levels may vary to increase the speed of operation of the device. As can be seen in FIG. 6, during the precharge time period of 6 μs, the internal data line and the pixel capacitor may be charged to a $V^+$ value that is less than the 5 volt maximum voltage. Then, during the 7 μs time period for the data lines to charge the pixel capacitors to the data input voltage level, it requires the same time for $\Delta V_2$ to go from $V^+$ to the maximum data voltage and for $\Delta V_1$ to be discharged to the minimum data voltage. In both cases, the charge time for $\Delta V_2$ and discharge time for $\Delta V_1$ can be shortened or optimized. The data line and the pixel capacitor charge time has been reduced to the amount of time required to obtain $\Delta V_2$ if further charging is required and, if the required data line predetermined voltage is less than 5 volts, the discharge time to the required level is reduced by the amount of time equal to discharge $\Delta V_1$. In this manner, the $V^+$ voltage level may be optimized so that the time difference between charging an internal data line and its associated pixel capacitor to the maximum input video data signal level, 5 volts for example only, and discharging an internal data line and its associated pixel capacitor to the minimum input video data signal level, 0 volts for example, is minimal. Thus, less precharge time is required because the pixel capacitors are not charged to the full value of 5 volts during the precharge time period. The same analysis applies to the $V^-$ voltage level as to the $V^+$ voltage level.

After all internal data lines and the pixel capacitors in a selected row such as 94, 96, - - - 98, and 100 are precharged to either $V^+$ or $V^-$ levels, the incoming video data signals (red, green, and blue) and their complementary signals are sent to the data input lines D1–D64. In this case, $D_1$, $D_3$, -

- - $D_{63}$ are positive polarity video signals and $D_2$, $D_4$, - - - $D_{64}$ are their complementary polarity video signals. These video signal voltages are shown in lines (i) and (j) in FIG. 4 as dashed lines following the precharge time. The control signals from demultiplexer driver circuit 102 on lines 104 and 106 are raised to 25 volts and 30 volts, respectively, as illustrated in line (f) for 7 μs. Each of the other X groups of input lines, in this case X=6, have the video data on lines 13 coupled thereto for 7 μs as shown in lines (f), (g), and (h) in FIG. 4. The reason to divide the data lines into two groups, even and odd, is because the data voltage polarity inversion scheme is used in this system. The data voltage polarity is altered between two fields of a TV frame. The last 7 μs of the 63 μs time interval is used to allow the pixels in the last group, group X, to settle better.

The demultiplexing transistors 108, 110 - - - 112, and 114 are switches, sized such that the internal data lines $D_1$–$D_{64}$ can be discharged to within 15 millivolts of the incoming video data color signal levels within the allocated time interval of 7 μs in this example. A successive operation is repeated for each of the demultiplexer circuits numbered 66 through 68, and 70, or all six groups.

At the beginning of the $n^{th}$ row line scanning operation, the pixel switching transistors in row n are already fully turned ON. Therefore, after the scanned row n–1 is deselected, the pixels in row n are then precharged. If the remaining 49 μs data input transfer time is allocated in essentially equal time periods of 8 microseconds each, the first block of the pixel transistors on columns $D_1$–$D_{64}$ in row n has the entire 49 microseconds for pixel discharge times, the second block of the pixel transistors in row n connected to columns $D_{65}$–$D_{128}$ has approximately 41 μs discharging time. The third block would have approximately 33 μs and so forth. The final block of the pixel transistors in row n would have substantially only 9 μs left for pixel discharging.

By allocating 7 μs of time to each of the six groups of pixel transistors and allowing the final 7 μs for pixel settling as indicated in FIG. 4(*d*), sufficient time is allowed for all of the pixel transistors to discharge. Short discharging time might produce an error voltage ΔV for the sixth block of the pixels. In order to reduce the ΔV and have a resolution of 256 grey levels, it is desirable to allocate the additional 7 microseconds for pixel settling time. In this case, 14 microseconds will be available for the sixth group of pixel capacitors to settle to their video signal level. As line n–1 is being deselected as indicated in line (e), line n is being selected and the voltage applied to that line is at the maximum of 20 volts as indicated (l).

It is to be understood that the demultiplex ratio affects the number of video leads and the number of signal input leads. It can be optimized or compromised according to the product application. For example, for high resolution and/or high picture quality, one can use a smaller demultiplex ratio so that more video signal leads per group could be coupled into the substrate 14 instead of 64. One can also reduce a large number of input lead counts for less demanding gray levels or slower speed video products.

Further, in the present application, the data lines and pixels are precharged to the highest needed voltage levels due to the fact that N-channel transistors are used for signal transferring and the data lines or pixels are discharged while inputting video signals because it is much easier and faster to discharge them than to charge them in order to obtain an accurate signal voltage.

Further, $\Phi_{1,e}$ and $\Phi_{1,o}$ (lines 104 and 106) can be combined into one control line signal feeding all the gates of multiplexing transistors 108, 110 - - - 112, and 114 in group 1. The combining of signals $\Phi_{1,e}$ and $\Phi_{1,o}$ can be accomplished when the gate voltage stress is not a concern and the device characteristics of the demultiplexing transistors 108, 110 - - - 112, and 114 are good enough to discharge the internal data lines and pixel capacitors uniformly. In like manner, the other demultiplexing line pairs such as 130 and 132 to the other five groups, including 68 and 70 in FIG. 2, can be combined into one control line for each pair. In such case, the number of multiplexer gate control lines can be reduced to one-half the number.

For the example given herein, a 384×240 pixel color hand-held TV is used. The horizontal pixel count is 384. The demultiplexer transistors 108, 110 - - - 112, and 114 are fabricated with thin-film transistors on the display itself to transfer the precharge voltage and video data and to interface the display directly to a video source. The precharge voltage is applied to all columns simultaneously. The video signals from a video source external to the display are arranged to come onto the display 64 data lines at a time using one-sixth of a designated line time interval. Twelve control signals, two to each of the six groups, enable demultiplexing transistors in six different blocks to sequentially transfer the incoming video signals to the display's six groups of 64 internal data lines. After completion of the video data transfer to the first 64 internal data lines, $D_1$–$D_{64}$, the next 64 video signals will be transferred to the internal data lines $D_{65}$ through $D_{128}$. This is done by enabling the second set of control signals of the demultiplexing circuit. As stated, each video data signal transfer takes place during one-sixth of the designated line time interval. This operation continues sequentially for all six demultiplexing circuits. The entire one row of video information is transferred to the internal data lines in 42 microseconds of allocated data input time.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

We claim:

1. A circuit for providing signal data to a display wherein the display has first and second substrates, at least the first of which is glass, separated by a layer of electro-optic material, the circuit comprising:

Y data input lines deposited on one of the substrates;

X groups of Y demultiplexer elements deposited on said one of the substrates wherein each demultiplexing element is connected to one of the Y data input lines;

a demultiplexing circuit external to the first substrate having X enabling signal lines respectively connected to the X groups of Y demultiplexing elements for enabling each of the X groups of Y demultiplexing elements;

a control circuit external to the substrates and providing a precharging voltage to the Y data input lines for a first time period and providing the signal data to the same Y data input lines for X successive second time periods; and the demultiplexing circuit simultaneously enabling all of the Y data input lines to the X groups during said first time period and sequentially enabling the Y data input lines to a corresponding one of the X groups of Y demultiplexing elements during said X successive second time periods.

2. The circuit of claim 1 further including:

X groups of Y switching transistors connected to corresponding X groups of Y capacitive pixel elements to form X groups of Y switching elements in each of Z rows corresponding and connected to the X groups of Y demultiplexing elements; and each capacitive pixel element having a first electrode deposited on the first substrate and a common electrode on the second substrate, each first electrode being coupled to a corresponding one of the Y switching transistors wherein each capacitive pixel element is precharged by the precharging voltage to a predetermined level.

3. The circuit of claim 2 further including:

a thin-film transistor forming each demultiplexing element and each switching transistor;

an enabling line pair forming each of the X enabling signal means deposited on the first substrate wherein a first one of an enabling line pair is coupled to each odd one of the demultiplexing elements of the respective group and the second one of an enabling line pair is coupled to each even one of the demultiplexing elements of the respective group for activating the odd and even input lines to odd and even ones of the switching transistors, respectively, in a selected one of the Z rows in each of the groups of switching elements as each row is sequentially activated to create a display picture from the signal data; and wherein the demultiplexing circuit provides an enabling signal to enable all of the X groups of Y demultiplexing elements simultaneously when the control circuit provides the precharging voltage to the input lines.

4. The circuit of claim 3 wherein:

X=6 groups;

Y=64; and

Z=240.

5. The circuit of claim 3 wherein the display picture is a television picture.

6. The circuit of claim 1 wherein the control circuit comprises:

a first precharge voltage source of predetermined value coupled to odd output lines $D_1$, $D_3$ - - - $D_{n-1}$ of the control circuit for providing the precharging voltage thereof;

a second precharge voltage source of predetermined value coupled to even output lines $D_2$, $D_4$ - - - $D_n$ of the control circuit for providing the precharging voltage thereof;

first gate means for selectively coupling the signal data to output lines $D_1$ through $D_n$;

second gate means for selectively coupling the first and second precharge voltage sources to the same output lines $D_1$ through $D_n$; and a gate control means for alternately enabling and disabling the first and second gate means such that only one gate means is enabled at a time.

7. The circuit of claim 1 wherein the display is a liquid crystal display.

8. A method of providing signal data to a display wherein the display has opposed first and second substrates, at least the first of which is glass, separated by a layer of electro-optic material, the method comprising the steps of:

depositing Y data input lines on the first substrate;

depositing X groups of Y demultiplexing switches on the first substrate;

coupling each demultiplexing switch to a respective one of the Y data input lines;

providing a precharging voltage to the Y input lines for a first time period;

providing the signal data to the same Y input lines for X successive second time periods;

enabling each of the X groups of Y demultiplexing switches simultaneously when the precharging voltage is provided during the first time period; and enabling each of the same X groups of Y demultiplexing switches consecutively and sequentially when the signal data is provided during the X successive second time periods.

9. The method of claim 8 further including the steps of:

connecting X groups of Y switching transistors to corresponding X groups of Y capacitive pixel elements in each of Z rows and to corresponding ones of the X groups of Y demultiplexing switches;

coupling a first electrode of each capacitive pixel element on the first substrate to a corresponding switching transistor, the pixel elements having a common electrode on the second substrate; and precharging each capacitive pixel element to a predetermined level with the precharging voltage during a first time period.

10. The method of claim 9 further including the steps of:

providing the video data to the Y input lines for X successive time periods after the first time period; and sequentially enabling the Y input lines coupled to the corresponding ones of the X groups of Y demultiplexing switches for each of the X successive time periods.

11. A method as in claim 8 wherein the display is a liquid crystal display.

12. A circuit for providing signal data to a display wherein the display has first and second substrates, at least the first of which is glass, separated by a layer of electro-optic material, the circuit comprising:

Y data input lines deposited on the first substrate;

X groups of Y pixel elements deposited on the first substrate wherein each pixel element in each of the X groups is connected to a respective one of the Y data input lines;

a single on-glass gating switch coupled to each respective one of the pixel elements in each of the X groups;

a first gate means external to the first substrate for providing precharging data to the Y data input lines;

a second gate means external to the first substrate for coupling signal data to the same Y data input lines;

a control circuit external to the first substrate and coupled to said first and second gates gate means for enabling the first gate means for a first time period to provide a precharging voltage to the Y data input lines;

the control circuit subsequently disabling the first gate means and enabling the second gate means to provide signal data to the same Y data input lines during X successive second time periods; through the same respective on-glass gating switches; and a demultiplexing circuit simultaneously enabling all X groups of Y data input lines during the first time period and sequentially enabling the X groups of Y data input lines during successive second time periods.

* * * * *

UNITED STATES PATENT AND TRADEMARK OFFICE

CERTIFICATE OF CORRECTION

PATENT NO. : 5,510,807

DATED : April 23, 1996

INVENTOR(S) : Lee et al.

It is certified that error appears in the above-indentified patent and that said Letters Patent is hereby corrected as shown below:

Column 10:

line 27, delete "video" and replace with --signal--;

lines 27 and 29, after "Y" and before "input" in each line, insert --data--;

Signed and Sealed this

Twenty-first Day of January, 1997

*Attest:*

*Attesting Officer*

Bruce Lehman

BRUCE LEHMAN

*Commissioner of Patents and Trademarks*